United States Patent [19]

Lezatte et al.

[11] 4,165,874

[45] Aug. 28, 1979

[54] GOLF CLUB SHAFT AND SET OF GOLF CLUBS

[75] Inventors: Arthur J. Lezatte, Downers Grove; Peter J. Piotrowski, Glen Ellyn, both of Ill.

[73] Assignee: Pepsico, Inc., Purchase, N.Y.

[21] Appl. No.: 833,248

[22] Filed: Sep. 14, 1977

[30] Foreign Application Priority Data

Oct. 13, 1976 [JP] Japan ..... 51-121903

[51] Int. Cl.[2] ..... A63B 53/12

[52] U.S. Cl. ..... 273/77 A; 273/80 B

[58] Field of Search ..... 273/77 R, 77 A, 80 R, 273/80 B, 167 F, 169, DIG. 23

[56] References Cited

U.S. PATENT DOCUMENTS

| | | | |
|---|---|---|---|
| 1,573,708 | 2/1926 | Hoerle | 273/80 B X |
| 1,670,531 | 5/1928 | Cowdery | 273/80 B |
| 1,765,709 | 6/1930 | Withington | 273/80 B X |
| 1,974,389 | 9/1934 | Cowdery | 273/80 B |
| 2,037,636 | 4/1936 | Lagerblade | 273/80 B |
| 2,066,962 | 1/1937 | Cross | 273/80 B |
| 2,100,307 | 1/1937 | McMinn | 273/80 B X |
| 3,809,403 | 5/1974 | Hunter | 273/80 B |
| 3,871,649 | 3/1975 | Kilshaw | 273/80 B X |

FOREIGN PATENT DOCUMENTS

| | | | |
|---|---|---|---|
| 3288 | of 1913 | United Kingdom | 273/80 B |
| 470178 | 8/1937 | United Kingdom | 273/80 B |
| 1159714 | 7/1969 | United Kingdom | 273/80 B |
| 1261541 | 1/1972 | United Kingdom | 273/DIG. 23 |

*Primary Examiner*—Richard J. Apley

*Attorney, Agent, or Firm*—Hill, Van Santen, Steadman, Chiara & Simpson

[57] ABSTRACT

An improved golf club shaft and golf club, the shaft being of stepped configuration, having a uniform outer diameter butt end portion having a uniform wall thickness at least 10 inches (254mm) long, the uniform wall thickness being not greater than 0.012 (0.305mm) and a plurality of cylindrical step portions of progressively smaller outer diameter terminating in a tapered tip end portion having a wall thickness at the tip end of at least 0.024 (0.610)mm). The shaft is characterized by a redistribution of metal which results in a balance point closer toward the tip of the shaft, making it possible to use a lighter head without affecting the swing weight.

7 Claims, 4 Drawing Figures

GOLF CLUB SHAFT AND SET OF GOLF CLUBS

BACKGROUND OF THE INVENTION

1. Field of the Invention

This invention is in the field of lightweight steel shafts for golf clubs, and golfs clubs having lighter heads made possible by the use of the improved shaft.

2. Description of the Prior Art

In recent years, there has been a significant trend toward the use of lightweight shafts and lightweight heads in golf clubs. The theory behind the lightweight club is that a lighter club at the same swing weight can be swung at a higher velocity for the same amount of swing energy, thereby transferring more momentum to the ball. It is an accepted fact that an increase in clubhead mass or an increase in clubhead velocity will cause an increase in ball velocity. The impact of the clubhead with the ball is governed by the equation:

$$Vb = \frac{(1 + e)\,Wc}{Wc + Wb}\,Vc \qquad \text{(Equation 1)}$$

where

Vc=clubhead velocity before impact

Vb=ball velocity after impact e=coefficient of restitution

Wc=weight of the clubhead

Wb=weight of the ball

All other things being equal, the ball velocity determines the distance the ball will travel. From Equation 1, the distance the ball will travel is inversely proportional to the weight of the clubhead plus the weight of the ball. This means that any change in clubhead weight will have only a small change in the distance the ball will travel. Again using Equation 1, the distance the ball will travel is directly proportional to the clubhead velocity. This means that any change in clubhead velocity will significantly change the distance the ball will travel.

Clubs have recently come on the market utilizing a composite shaft of graphite fibers in a synthetic resin matrix. Such shafts commonly weigh only about 2.5 ounces (70.75 g). While this represents a substantial improvement over a conventional steel shaft which may weigh 4 ounces (113.2 g), the cost of the shaft is sufficiently high so that it is out of the reach of the average player. Player acceptance of these shafts has been low since the feel is much different than steel shafts and the torsional resistance of the shaft causes clubhead rotation during the swing which causes inaccurate shots.

SUMMARY OF THE INVENTION

The present invention provides a golf shaft which permits the manufacture of a golf club with a lighter overall club weight than clubs using conventional "lightweight" steel shafts. When using the improved shafts, the clubhead weights are reduced, the clubhead velocity is increased, and an increase in ball travel results. The shafts of the present invention are characterized by a large, thin uniform diameter butt end portion having a length of at least 10 inches (254 mm), a uniform wall thickness not greater than 0.012 inch (0.305 mm) and an outer diameter of at least 0.620 inch (15.75 mm). The club shaft terminates in a tapered tip end portion having a wall thickness at the tip end of at least 0.024 inch (0.610 mm). An additional improvement is provided by using a lightweight flexible grip weighing no more than 1-13/32 ounces (40.00 g) on the butt end portion of the shaft. When the shafts are employed in a series of irons ranging from the No. 2 iron to the No. 9 iron, the club head for the No. 2 iron weighs not more than 8-5/16 ounces (235.7 g) and the club head for the No. 9 iron weighs not more than 9-7/8 ounces (280 g). These weights are for a D2 swing weight and many increase or decrease with increases and decreases in swing weight.

Swingweight is determined in the usual manner by subtracting 12 inches (304.8 mm) from the balance point and multiplying the difference by the total weight of the club. A D2 swingweight corresponds to a product of 244 oz. inches.

The larger butt end adds stiffness while the resulting thinner wall reduces the weight of the butt end. This moves the balance point on the shaft closer to the tip. As the balance point is moved, a lighter head weight can be used for the same swing weight, thus reducing the overall club weight. The use of a larger butt increases the stiffness enough to allow the use of a conventional "R" or regular flex step pattern to produce an "S" or stiff flex shaft. Accordingly, "S" flex shafts can now be manufactured by only changing the step pattern. Prior art required both a change in step pattern and an increase in weight to change the stiffness. Furthermore, we can use the same club weight for clubs of different stiffness characteristics.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figures 1, 2, 3, 4:
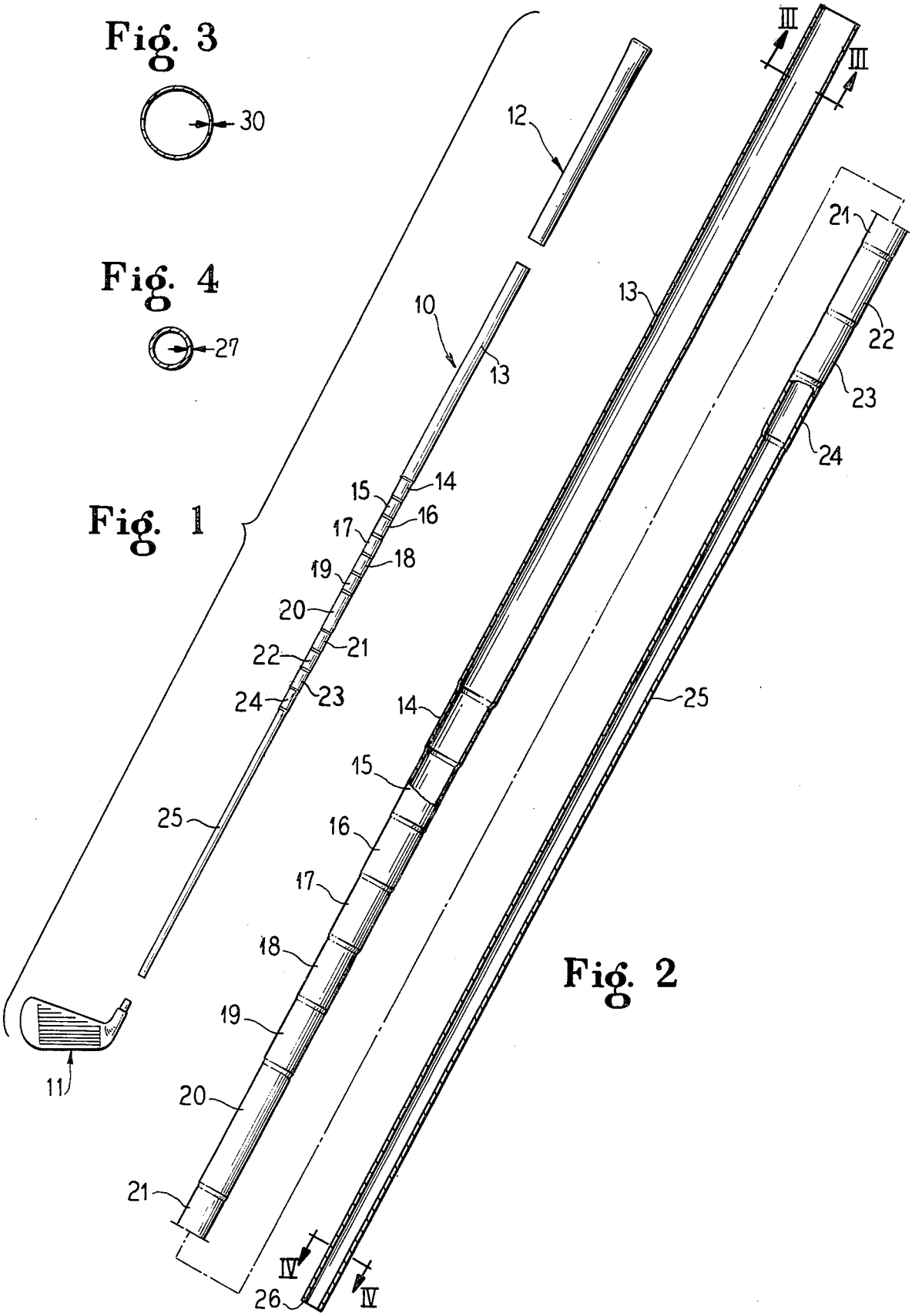
FIG. 1 is an exploded view of a golf club employing the improvements of the present invention.
FIG. 2 is a view partly in elevation and partly broken away illustrating the entire stepped configuration of the shaft.
FIG. 3 is a cross-sectional view taken substantially along the line III—III of FIG. 2.
FIG. 4 is a cross-sectional view taken substantially along the line IV—IV of FIG. 2.

In FIG. 1 there is illustrated an improved golf club according to the present invention including a shaft 10, an iron type club head 11 tightly engageable with the tip end of the shaft 10, and a flexible grip 12 which fits over a major portion of the butt end of the shaft 10. The shaft 10 has a step pattern which includes an extended butt end portion 13 measuring at least 10 inches (254 mm) in length and having a uniform wall thickness not greater than 0.012 inch (0.305 mm). The outer diameter of the butt end portion 13 is at least 0.620 inch (15.75 mm). Following the butt end portion 13 there is a series of equal steps 14 through 19 each of progressively smaller outer diameter and progressively increasing wall thickness. The wall thickness of the butt end portion, illustrated at reference numeral 30 in FIG. 3 is not greater than 0.012 inch (0.305 mm).

Step 14 typically has an outer diameter of 0.600 inch (15.24 mm), step 15 typically has an outer diameter of 0.580 inch (14.73 mm), and step 16 has an outer diameter of about 0.560 inch (14.22 mm). Step 17 may have an outer diameter of 0.540 inch (13.72 mm), step 18, an outer diameter of 0.520 inch (13.21 mm), and step 19, an outer diameter of 0.500 inch (12.7 mm). The next step, step 20, is an extended step measuring twice or more in length as compared with steps 14 to 19, inclusive. A typical outer diameter for the elongated step 20 is 0.485 inch (12.32 mm).

Proceeding toward the tip end, there is a series of additional steps 21 through 24, inclusive, again of decreasing outer diameter but progressively increasing wall thickness. Step 21, for example, typically measures 0.470 inch (11.94 mm) while step 22 may measure 0.455 inch (11.56 mm). Step 23 may have an outer diameter of 0.440 inch (11.18 mm) while step 24 may have an outer diameter of 0.425 inch (10.80 mm). Finally, there is an extended tapered tip portion 25 which terminates in a tip end having an outer diameter of about 0.355 inch (9.02 mm). The wall thickness of the tip end 26, illustrated by reference numeral 27 in FIG. 4 is at least 0.024 inch (0.610 mm) so that it is at least twice as thick as the butt end portion 13.

The grip 12 can be made of natural or synthetic rubber, a cork composition or other lightweight material. In order to preserve the improvements of the present invention with respect to shifting the balance point, the flexible grip 12 should not weigh more than about 1-13/32 ounces (40.00 g).

Typical iron type club produced according to the present invention has a shaft measuring 38-½ inches (977.9 mm), the shaft weighing between 3¾ and 4 ounces (106.1 to 113.2 g). Its balance point is located between 19 and 19½ inches (482.6 to 494.3 mm) from the tip end. It has a tip diameter of 0.355 inch (9.0 mm) and a tip wall thickness of 0.026 inch (0.66 mm). The butt diameter measures 0.620 inch (15.75 mm) and the butt wall thickness is 0.012 inch (0.305 mm).

From the foregoing it will be understood that the improved golf club made with the improved shaft of the present invention is lighter than clubs containing lightweight steel shafts presently on the market. This feature, coupled with the extended thin wall butt portion and the reduction in weight in the grip increases the velocity of the club head and therefore ball velocity by a factor significantly greater than the reduced mass of the club head tends to reduce ball velocity. The result is an improved golf club or set of clubs which is capable of hitting the ball farther than with conventional steel shafts.

It should be evident that various modifications can be made to the described embodiments without departing from the scope of the present invention.

We claim as our invention:

1. A metal golf club shaft of stepped configuration having a uniform outer diameter, uniform wall thickness butt end portion at least 10 inches (254 mm) long, said uniform wall thickness being not greater than 0.012 inch (0.305 mm), said butt end portion terminating in a plurality of cylindrical step portions of progressively smaller outer diameter and progressively increasing wall thickness terminating in an intermediate cylindrical step portion of smaller outer diameter, greater wall thickness and of increased longitudinal extent than the cylindrical steps, said intermediate cylindrical step portion terminating in a plurality of cylindrical step portions of progressively smaller outer diameter and a progressively increasing wall thickness and terminating in a tapered tip end portion having a wall thickness at the tip end of at least 0.024 inch (0.610 mm).

2. A golf club shaft according to claim 1 in which the outer diameter of said butt end portion is at least 0.620 inch (15.75 mm).

3. A golf club shaft according to claim 1 in which said butt end portion is at least partly covered with a flexible grip weighing no more than 1-13/32 ounces (40.00 g).

4. A set of golf irons containing at least the series of irons ranging from the No. 2 iron to the No. 9 iron, said irons each including a metal shaft having a butt end portion terminating in a plurality of cylindrical step portions of progressively smaller outer diameter and progressively increasing wall thickness, said cylindrical step portions terminating in a tapered tip portion, the butt end portion of each iron club being of uniform wall thickness and being at least 10 inches (254 mm) long and having an outer diameter of at least 0.620 inch (15.75 mm), a flexible grip covering at least a portion of the butt end portion of each club, said grip weighing no more than 1-13/32 ounces (40.00 g) and a club head of different loft secured to the tip end of each shaft, the club head for the No. 2 iron weighing not more than 8-5/16 ounces (235.7 g) and the club head for the No. 9 iron weighing not more than 9⅞ ounces (280 g) for D2 swingweight.

5. A set of golf irons according to claim 4 in which said tapered tip portion has a wall thickness of at least 0.024 inch (0.61 mm).

6. A set of golf irons according to claim 4 in which the butt end portion of each shaft has a wall thickness not exceeding 0.012 inch (0.305 mm).

7. A set of golf irons containing at least a series of irons from the No. 2 iron to the No. 9 iron, said irons each including a metal shaft having a butt end portion terminating in a plurality of cylindrical step portions of progressively smaller outer diameter and progressively increasing wall thickness, said cylindrical step portions terminating in a tapered tip portion, the butt end portion of each shaft being at least 10 inches (254 mm) long and having a uniform wall thickness not exceeding 0.012 inch (0.305 mm), a flexible grip covering at least a portion of the butt end portion of each club, said grip weighing no more than 1-13/32 ounces (40.00 g), said tapered tip on each shaft having a wall thickness of at least 0.024 inch (0.61 mm) and a club head of different loft secured to the tip end of each shaft, the club head for the No. 2 iron weighing not more than 8-5/16 ounces (235.7 g) and the club for the No. 9 iron weighing not more than 9⅞ ounces (280 g) for D2 swingweight, each shaft weighing between 3¾ and 4 ounces (106.1 to 113.2 g).

* * * * *